US006229105B1

(12) United States Patent
Huang

(10) Patent No.: US 6,229,105 B1
(45) Date of Patent: May 8, 2001

(54) MAIN SWITCH WITH EXTENDED MULTIPLE INDIVIDUAL CONDUCTING PLATES

(76) Inventor: Chyong-yen Huang, No. 12, Alley 10, Lane 140, Sec. 1, Shin-Sheng South Rd., Taipei (TW)

( * ) Notice: Subject to any disclaimer, the term of this patent is extended or adjusted under 35 U.S.C. 154(b) by 0 days.

(21) Appl. No.: 09/567,775

(22) Filed: May 9, 2000

(51) Int. Cl.[7] ..... H01R 13/70
(52) U.S. Cl. ..... 200/16 R; 200/51 R; 200/51.11
(58) Field of Search ..... 200/16 R, 16 E, 200/16 F, 17 R, 18, 51 R, 51.02–51.06, 51.11, 51.12, 284; 439/188, 189, 650–654

(56) References Cited

U.S. PATENT DOCUMENTS 4,080,518 * 3/1978 Marrero ..... 200/51 R
5,659,209 * 8/1997 Huen ..... 307/125
5,857,870 * 1/1999 Carter ..... 439/402
6,054,657 * 4/2000 Liao ..... 200/51.02

* cited by examiner

*Primary Examiner*—Michael Friedhofer
(74) *Attorney, Agent, or Firm*—Rosenberg, Klein & Lee

(57) ABSTRACT

A main switch with extended multiple individual conducting plates is provided, each switch comprises three conducting plates. A first conducting plate has a first fin extending into the main switch. A second conducting plate also comprises a second fin which extends into the main switch. The first and the second fins are positive terminals and are controlled by the corresponding switch to turn on and off. A third conducting plate has a third fin which is a negative terminal. Both the second and the third conducting plates comprise at least one clip extending outwardly to form conductors of a receptacle.

4 Claims, 13 Drawing Sheets

MAIN SWITCH WITH EXTENDED MULTIPLE INDIVIDUAL CONDUCTING PLATES

BACKGROUND OF THE INVENTION

1. Field of the Invention

This invention relates to a main switch with extended multiple individual conducting plates, more particularly to a switch having extending conducting with multiple clips.

2. Prior Art

A conventional extension receptacle has a number of receptacle modules. Each receptacle module is controlled by an individual switch to connect or to cut the power supply. As shown in FIG. 13, an electrical extension receptacle comprises an extension cored receptacle A having a number of receptacle modules A1. Each of the receptacle modules A1 is accompanied by a switch A2 (various types of switches are used, i.e. switches include an indicator, or an overload protector) to control the electric power supplied to the receptacle module A1. As shown in FIG. 14, a positive terminal A21 of the switches A2 are respectively connected to each other by a copper wire A6, and then connected to one end A31 of an overload protector A3. Whereas the other end A32 of the overload protector A3 is connected to a positive end of the incoming power supply. The other end A22 of the switches A2 are respectively bridged to the positive end A11 of the corresponding receptacle modules A1 by respective copper wires A5. A negative end A23 of the switches A2 are respectively bridged to a negative end A12 of the corresponding receptacle modules A1 by respective copper wires A41. Whereas the negative end A23 of the first switch A2 is connected to each negative end A12 of the receptacle modules A1 by a long copper wire A4, which connects to the incoming negative end of the power supply. The above mentioned receptacle modules A1 of the extension cord receptacle A use the corresponding switches A2 to individually control power being supplied. In order to have a good connection at each connecting unit between the switches A2 and the receptacle modules A1, welding is used.

However, that assembly has some shortcomings, such as:

1. the process of welding may cause bad connections,
2. the assembly procedure is complicated, and
3. the labor cost is high.

SUMMARY OF THE INVENTION

It is the primary object of the present invention to provide a main switch with extending conducting plats to form direct contact points to simplify welding procedures.

It is another object of the present invention to provide a main switch with extending multiple individual conducting plates which is capable of being expanded to have more receptacle connections.

It is a further object of the present invention to provide a main switch with extending multiple conducting plates which is convenient in use and inexpensive to manufacture.

DETAILED DESCRIPTION OF THE PREFERRED EMBODIMENTS

Figure 1:
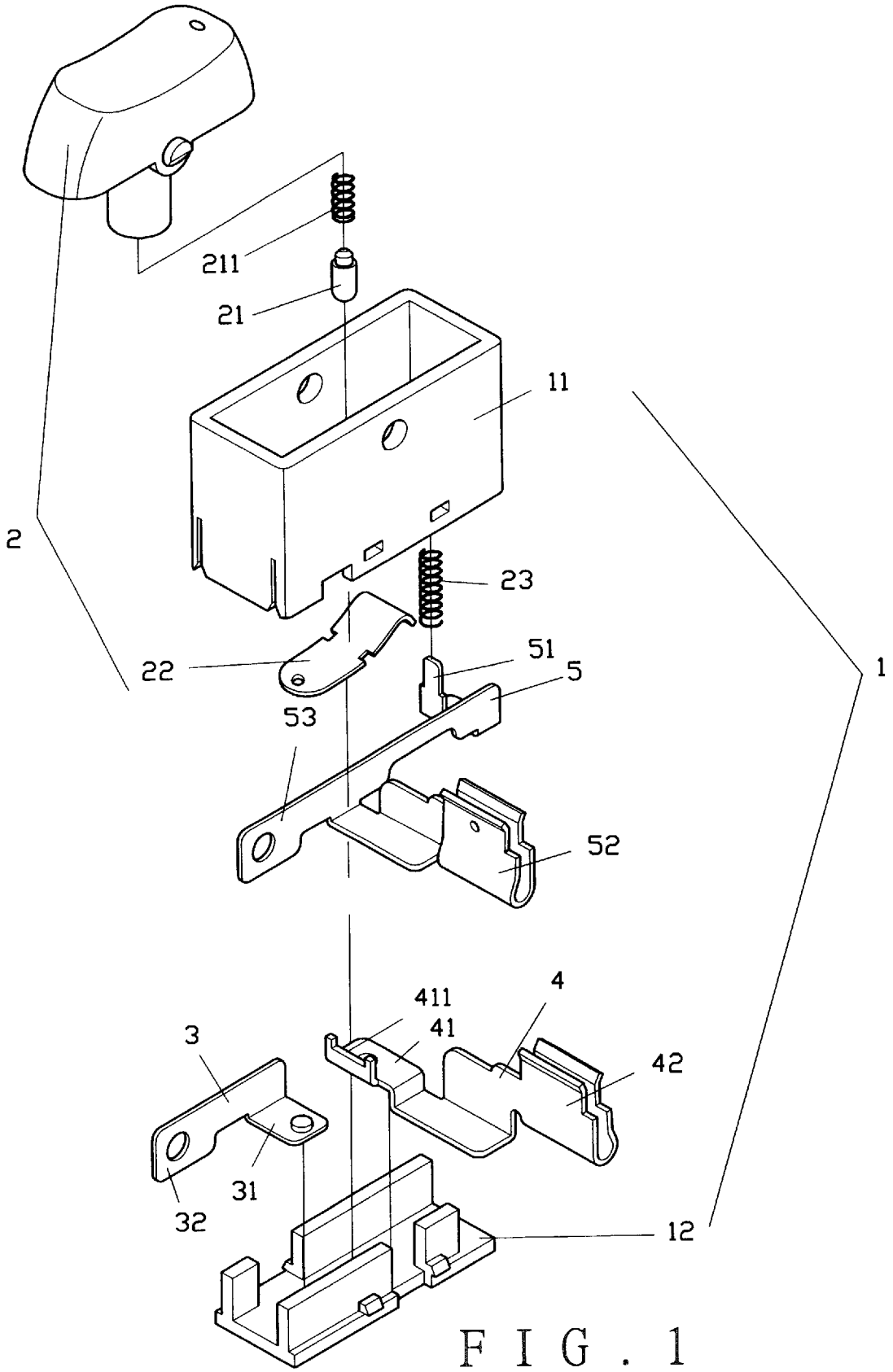
FIG. 1 is an exploded view of the present invention.

A main switch with extending multiple conducting plats comprises a main switch 1, a switch device 2, and conducting plates 3, 4 and 5.

The main switch 1 is formed by a switch box 11 and a seat 12, that may be formed as a single side of the switch box 11. The switch box 11 receives the switch device 2, which may be a toggle or push type, and comprises an internal indicator. The switch device 2 has a post 21 with a spring 211 at the bottom portion thereof, one end of the post 21 being connected to the indicator and the other end extending to switch a plate 22 in the main switch 1.

The main switch 1 has a first conducting plate 3, a second conducting plate 4, and a third conducting plate 5. The third conducting plate 5 is a negative conductor having a third fin 51 at one side to receive a spring 23 on one end thereof. The other end of the spring 23 is connected to the indicator of the switch device 2 and thus closes the circuit for the indicator. In the event that no indicator is provided, the third fin 51 and the spring 23 may be eliminated. The first conducting plate 3 is a positive conductor which connects the incoming power supply to form a closed circuit. The first conducting plate 3 has a preset first fin 31 which is located in the switch box 11. The second conducting plate 4 is another positive conductor having a positive outlet extending into the switch box 11 that forms a second fin 41 in the switch box 11. The second fin 41 has a notch 411 on the top edge portion to receive the plate 22 of the switch device 2 therein. The plate 22 is controlled by the post 21 to engage or disengage with the first fin 31 of the first conducting plate that controls the connection between the first conducting plate 3 (the input positive conductor) and the second conducting plate 4 (the output positive conductor). Both of the second conducting plate 4 and the third conducting plate 5 respectively have a second clip 42 and a third clip 52 extending therefrom. The second clip 42 is the positive end and the third clip 52 is the negative end. The second and the third clips 42 and 52 are each formed in a U-shaped contour in correspondence to the contour of a plug foot. Various shapes may be used for the slips 42 and 52, so long as they are able to hold a plug firmly therein.

Figure 2:
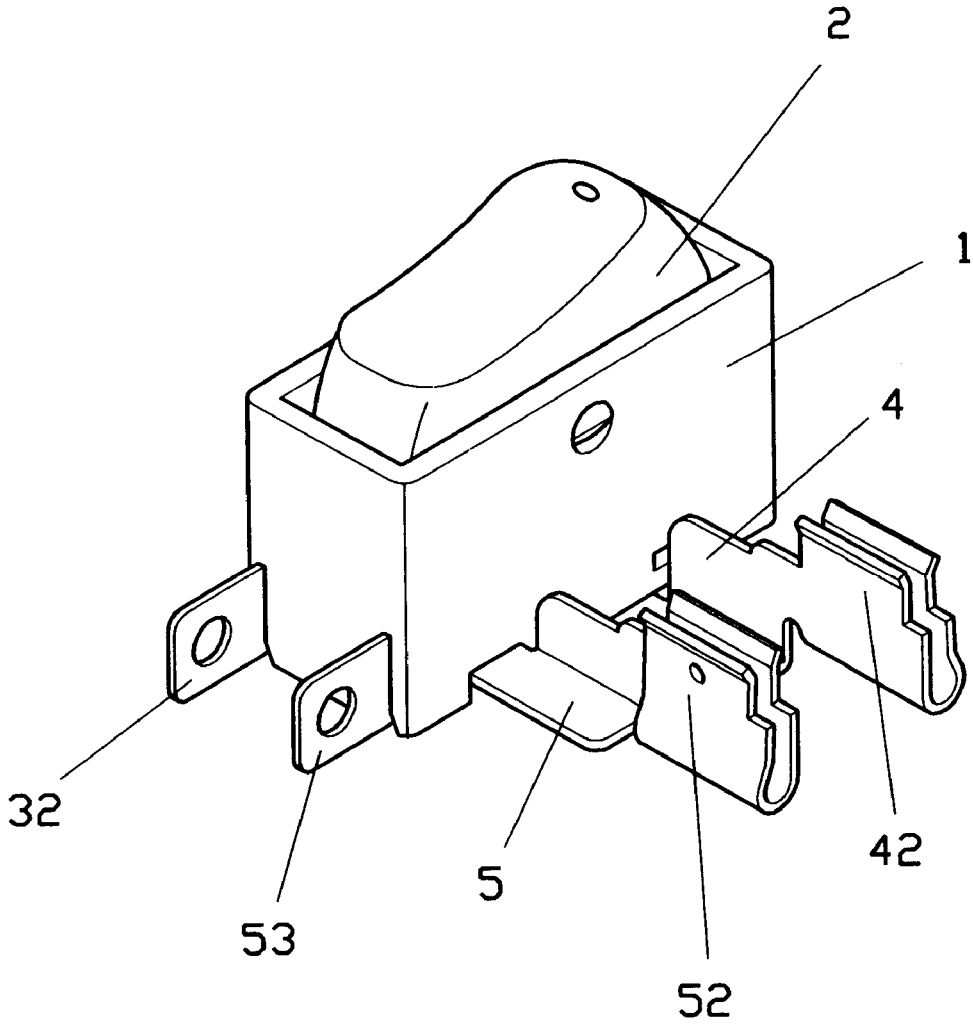
FIG. 2 is a perspective view of the present invention.
Figure 3:
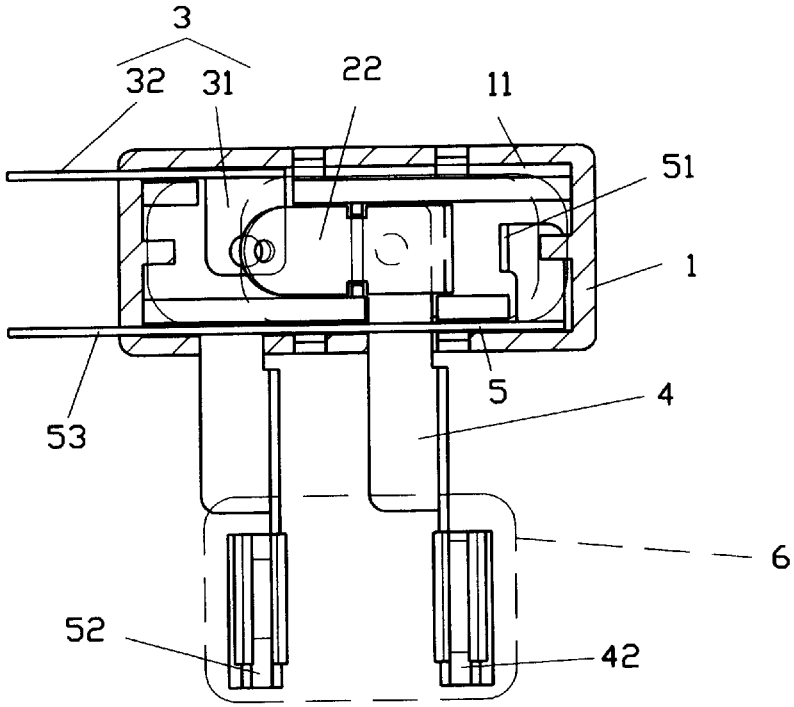
FIG. 3 is a top view of FIG. 2, partially sections.
Figure 4:
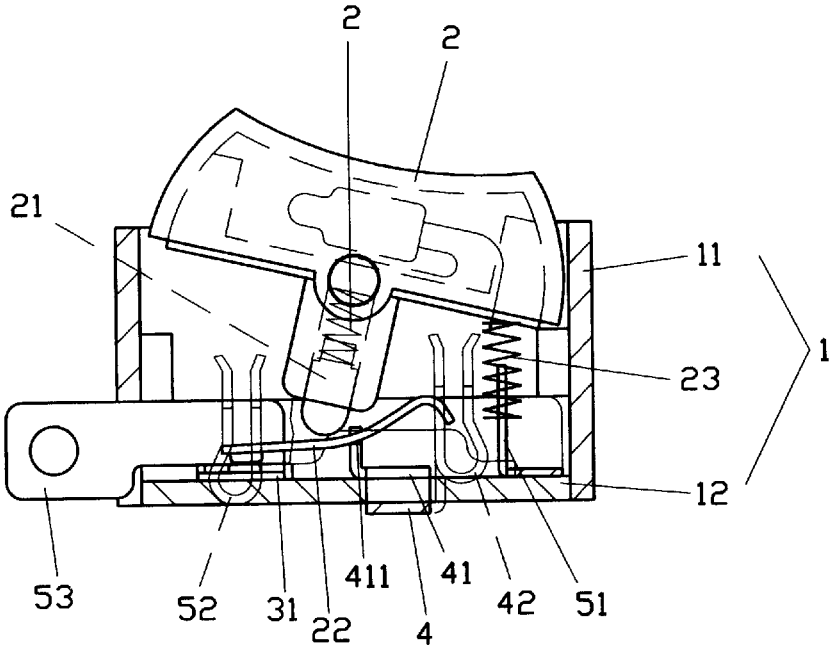
FIG. 4 is a side view of FIG. 2, partially sections.
Figure 5:
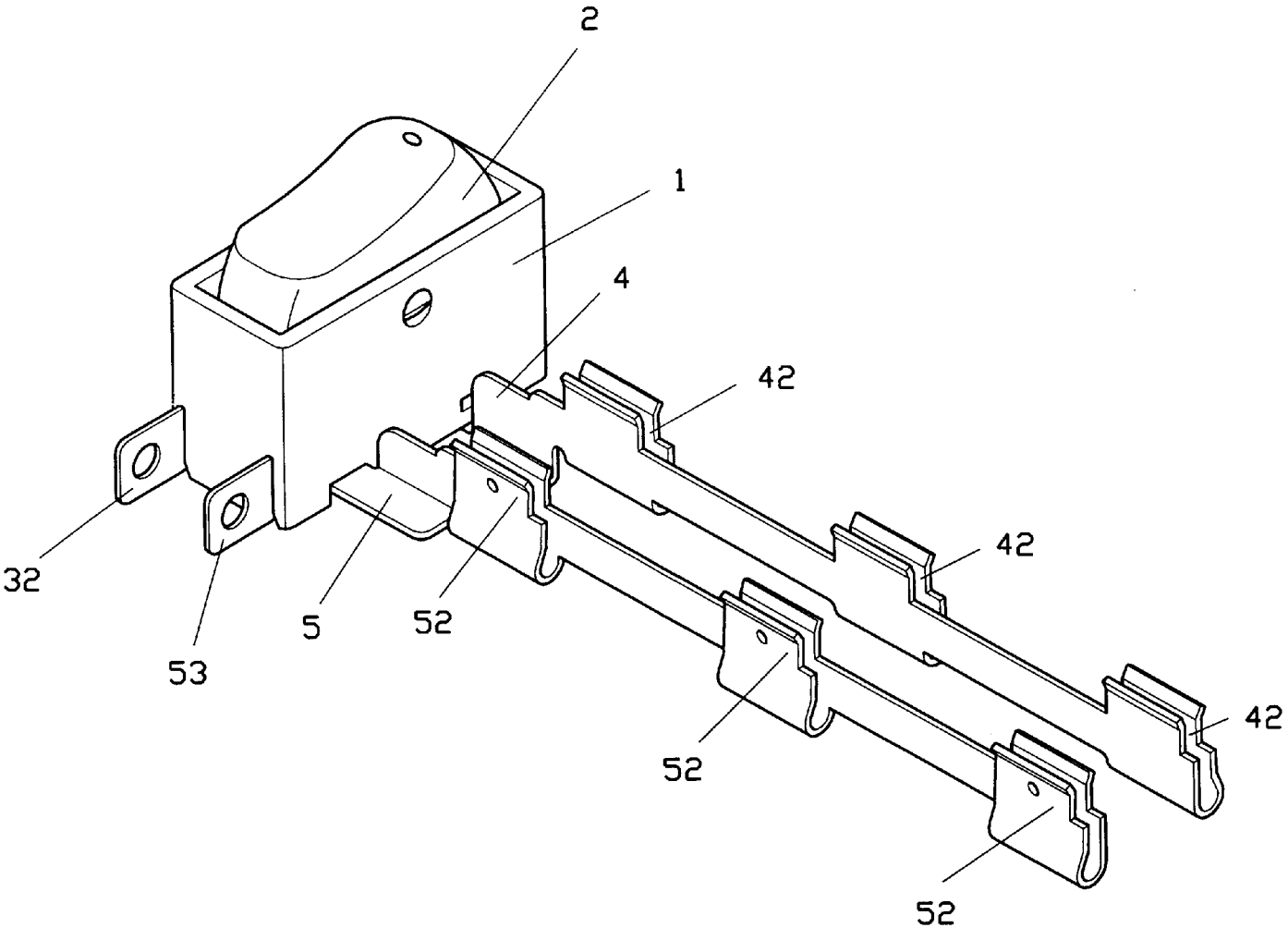
FIG. 5 is a perspective view of a first embodiment of the present invention.

FIG. 2 is a perspective view of FIG. 1 of the invention, the positive conductor and the grounded conductor (referring to the second conducting plate 4 and the third conducting plate 5) of the switch device 2, from which extend individual conducting slips, such as the second clip 42 and the third clip 52, respectively. Referring to FIGS. 3 and 4, the first conducting plate 3, the second conducting plate 4 and the third conducting plate 5 respectively have the first fin 31, second fin 41 and third fin 51 extending into the switch box 11 of the main switch 1, forming the switching contacts. The switch device 2 utilizes its post 21 at the bottom portion to press the plate 22 to engage and disengage with the first contact fin 31 in order to connect or disconnect the power of the main switch 1. The above invention has eliminated welding. The second conducting plate 4 and the third conducting plate 5 of the present invention, as shown in FIG. 5, can have a plurality of second clips 42 and third clips 52 extending therefrom, that are controlled by a single switch device 2 to be connected or disconnected from the power supply.

Figure 6:
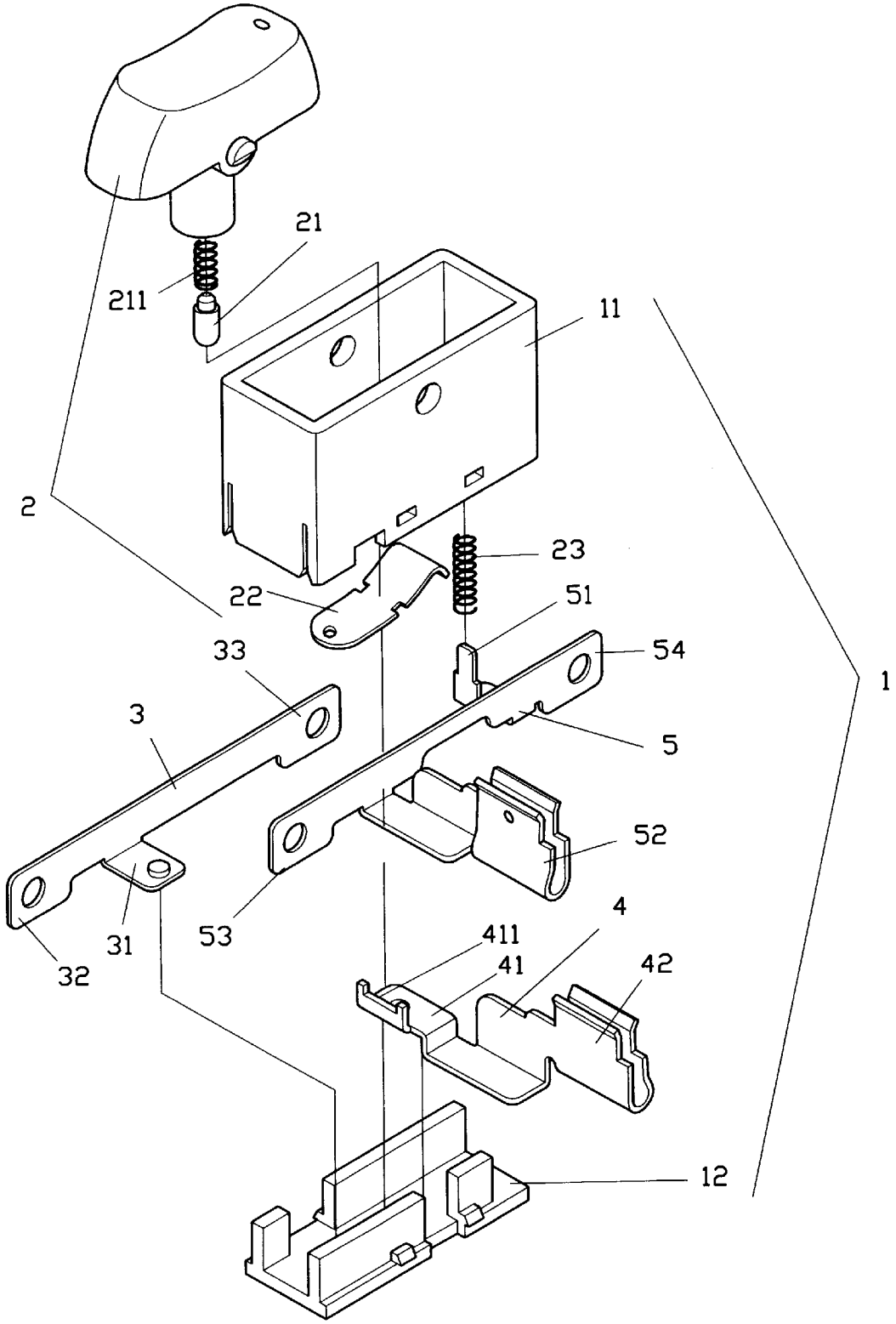
FIG. 6 is an exploded view of a second embodiment of the present invention.
Figure 7:
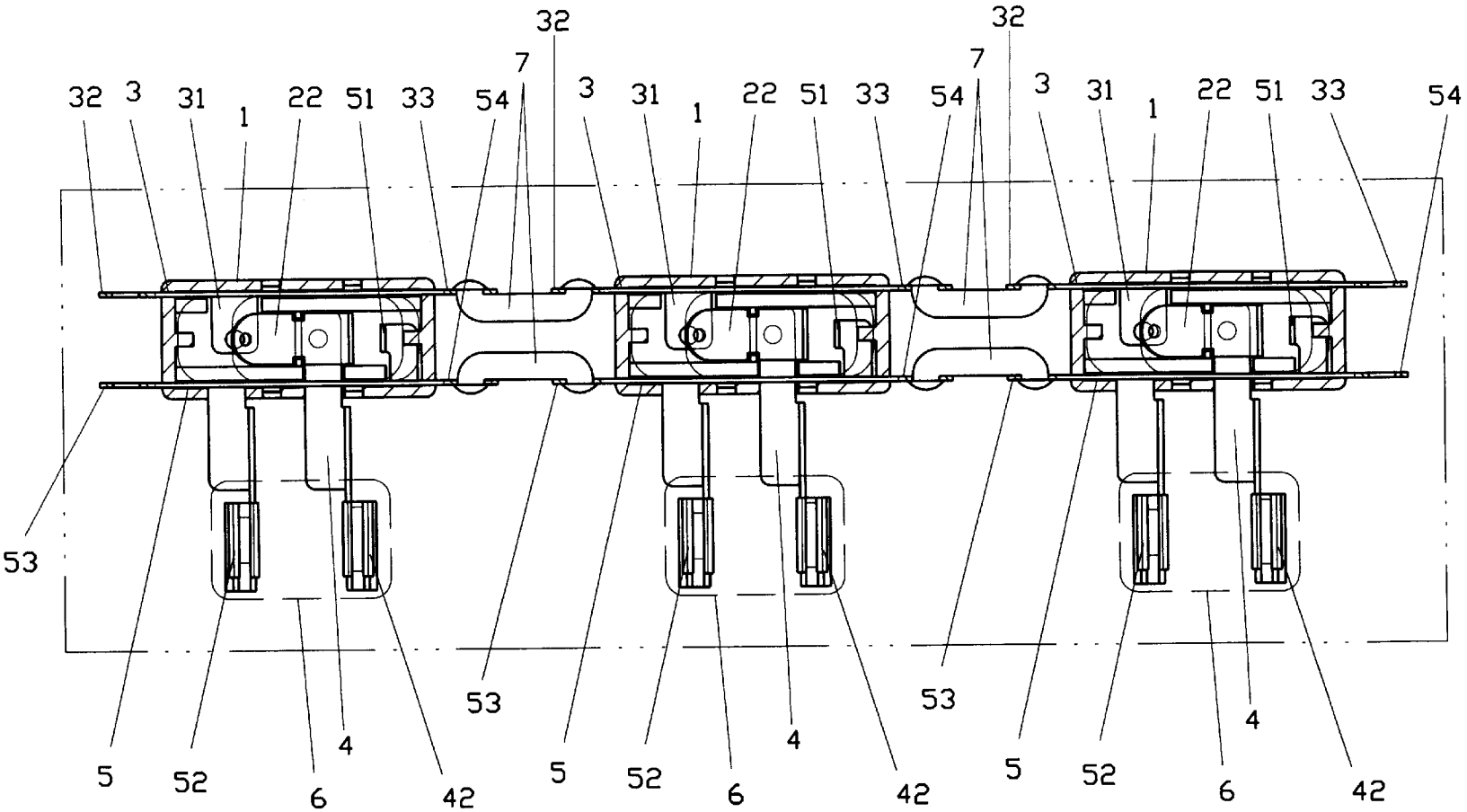
FIG. 7 is a top view of the second embodiment of the present invention.

FIG. 6 shows both the first conducting plate 3 and the third conducting plate 5 having series input connection ends 32 and 53, and series output connection ends 33 and 54. The series input connection ends 32 and 53, and the series output connection ends 33 and 54 may be formed in respective male and female configurations or any other configuration. FIG. 7 shows the multiple switches connected in series by the series input connection ends 32 and 53, and the series output connection ends 33 and 54 of the first conducting plate 3 and the third conducting plate 5.

Figure 8:
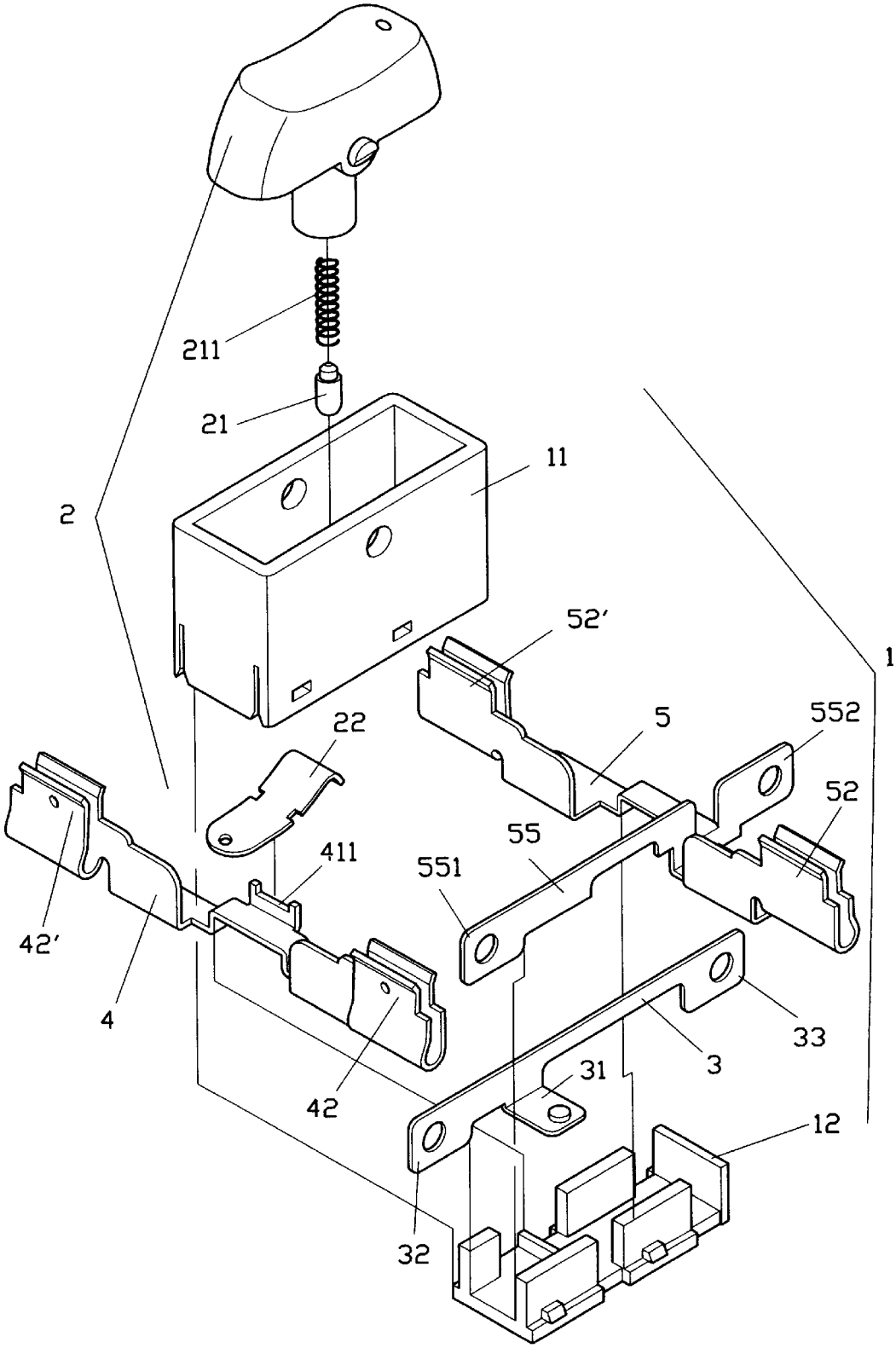
FIG. 8 is an exploded view of a third embodiment of the present invention.

In the above example, an indicator was included within the switch device 2. FIG. 8 shows another embodiment of the present invention that does not have an indicator incorporated in the switch device 2. The conducting plates are of different types as well. The first conducting plate 3 has a longitudinally extended shape with the first fin 31 extending from the inner end thereof. The first conducting plate 3 has its two ends formed as the series connecting input end 32 and connecting output end 33, respectively. The second conducting plate 4 has two ends respectively forming a pair of second clips 42 and 42', and the center portion of the second conducting plate 4 is formed with a notch 411 to receive the plate 22 therein. The third conducting plate 5 has its two ends respectively forming a pair of third clips 52 and 52', and the center portion thereof has a side plate 55 which has two ends formed as a connecting input end 551 and a connecting output end 552.

Figure 9:
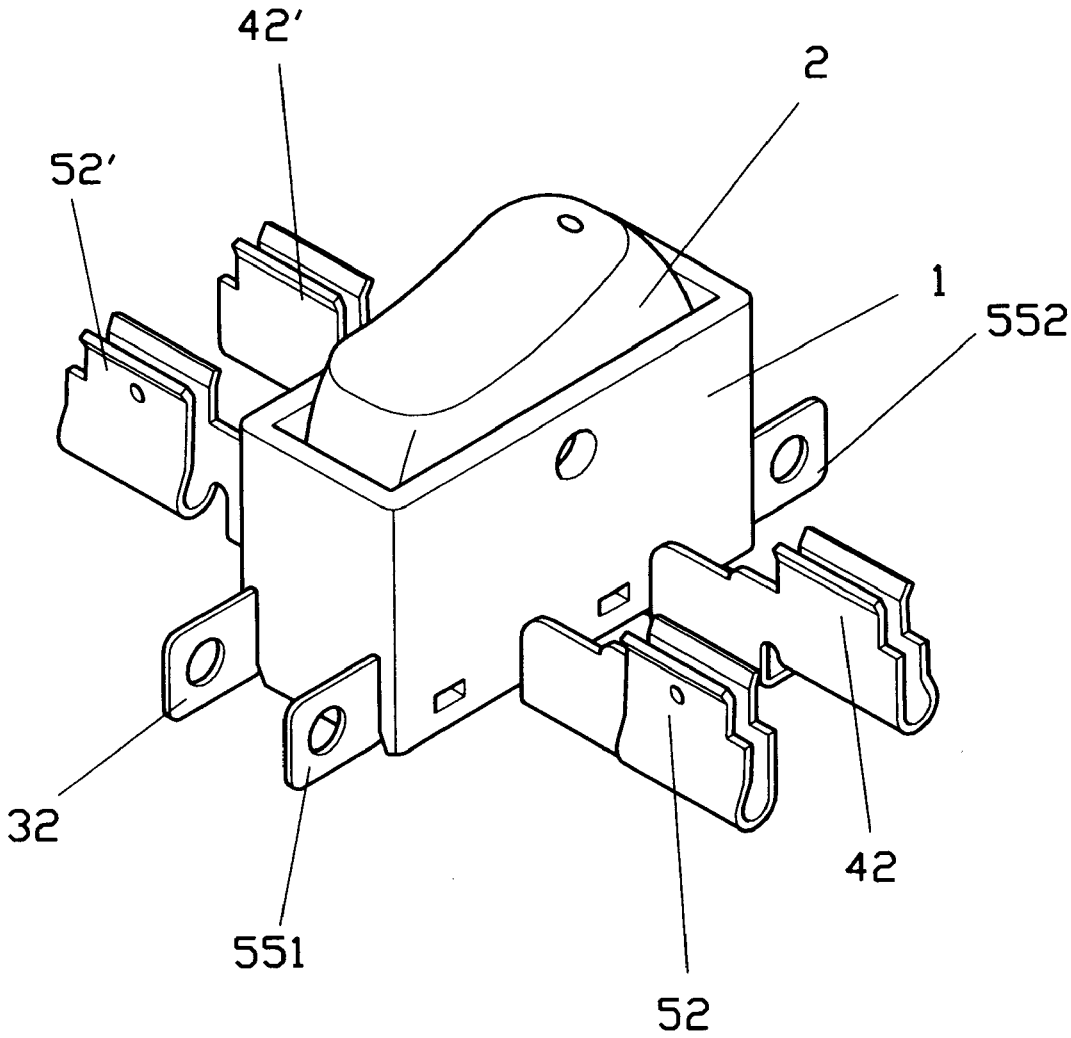
FIG. 9 is a perspective view of FIG. 8.
Figure 10:
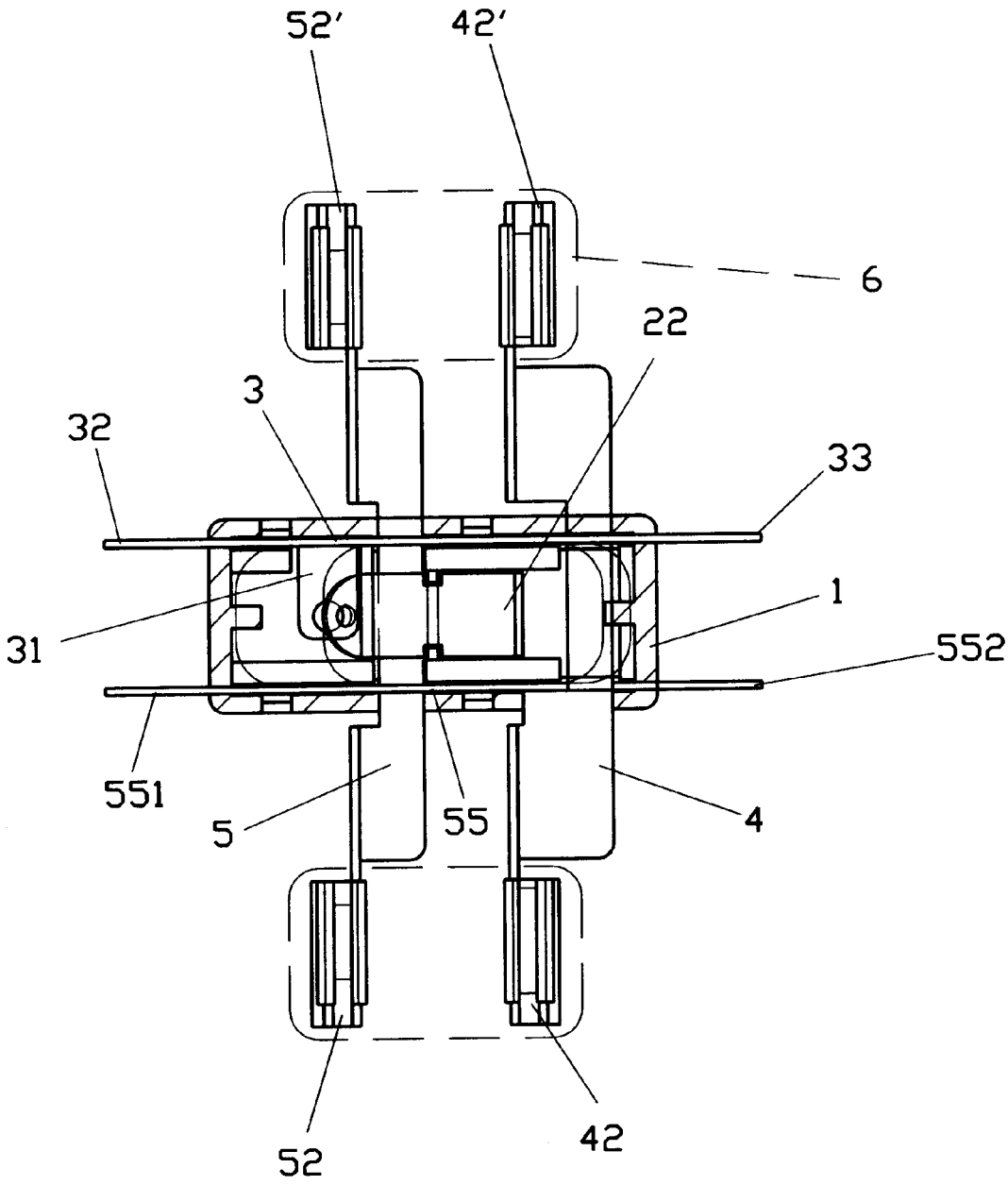
FIG. 10 is a top view of FIG. 8.

In the assembly as shown in FIGS. 9 and 10, the first conducting plate 3 is placed in the main switch 1, and the side plate 55 of the third conducting plate 5 crosses over the second conducting plate 4. The connecting input end 551 and the connecting output end 552 of the third conducting plate 5 and the connecting input end 32 and the connecting output end 33 of the first conducting plate 3 are connected to the main switch, and are laid flat on respective outer sides of the main switch 1. Owing to the second conducting plate 4 and the third conducting plate 5 being formed with multiple second and third clips 42, 42', 52, and 52', the main switch 1 has contacts in two receptacles 6. Thus, a switch device 2 can control two receptacles 6, at one time.

The receptacle 6 as shown in the above embodiments may be formed with the pair of second clips 42 and 42' and the pair of third clips 52 and 52', or it may be formed integrally with the main switch.

Figure 11:
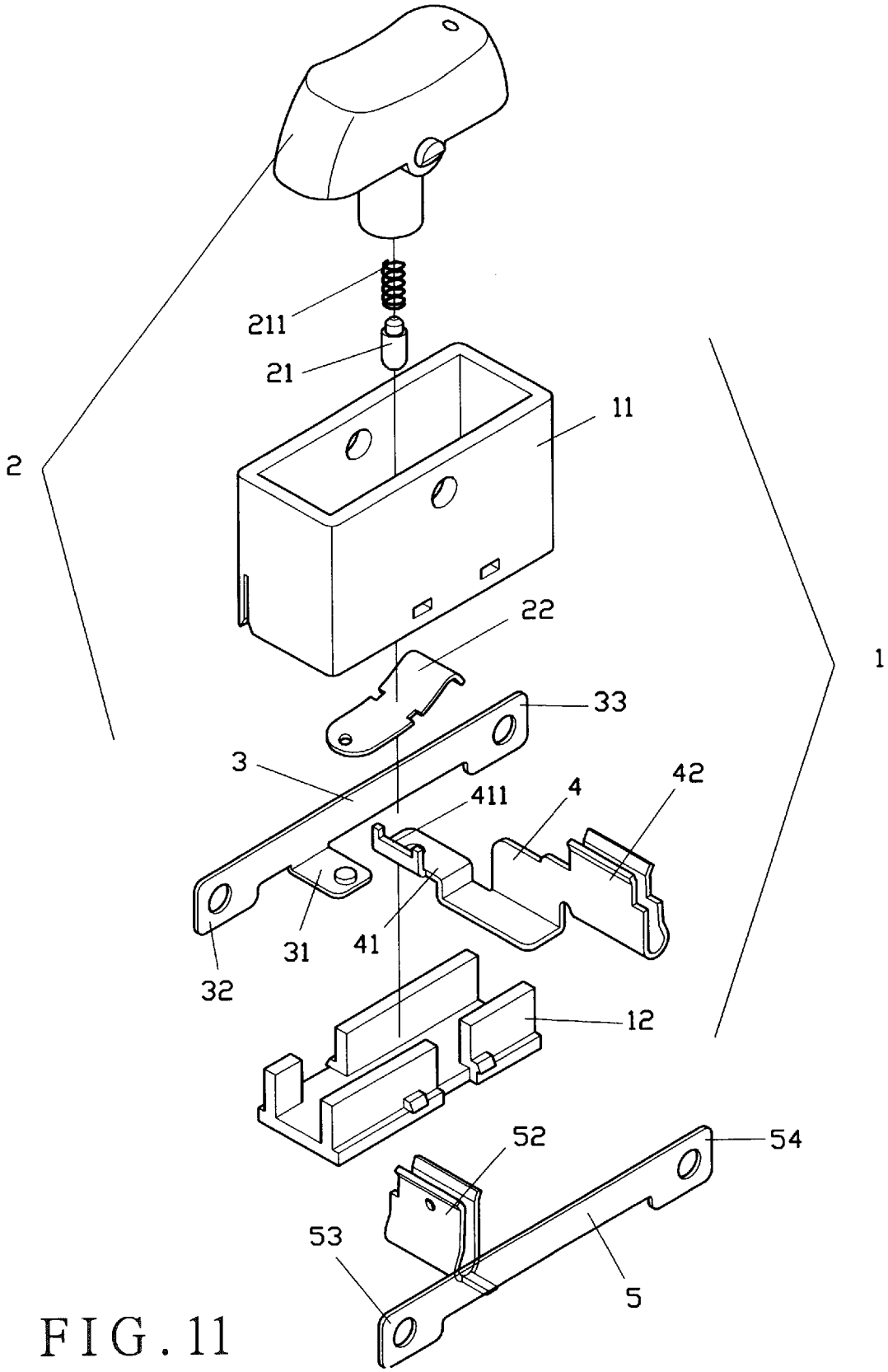
FIG. 11 is an exploded view of a fourth embodiment of the present invention.
Figure 12:
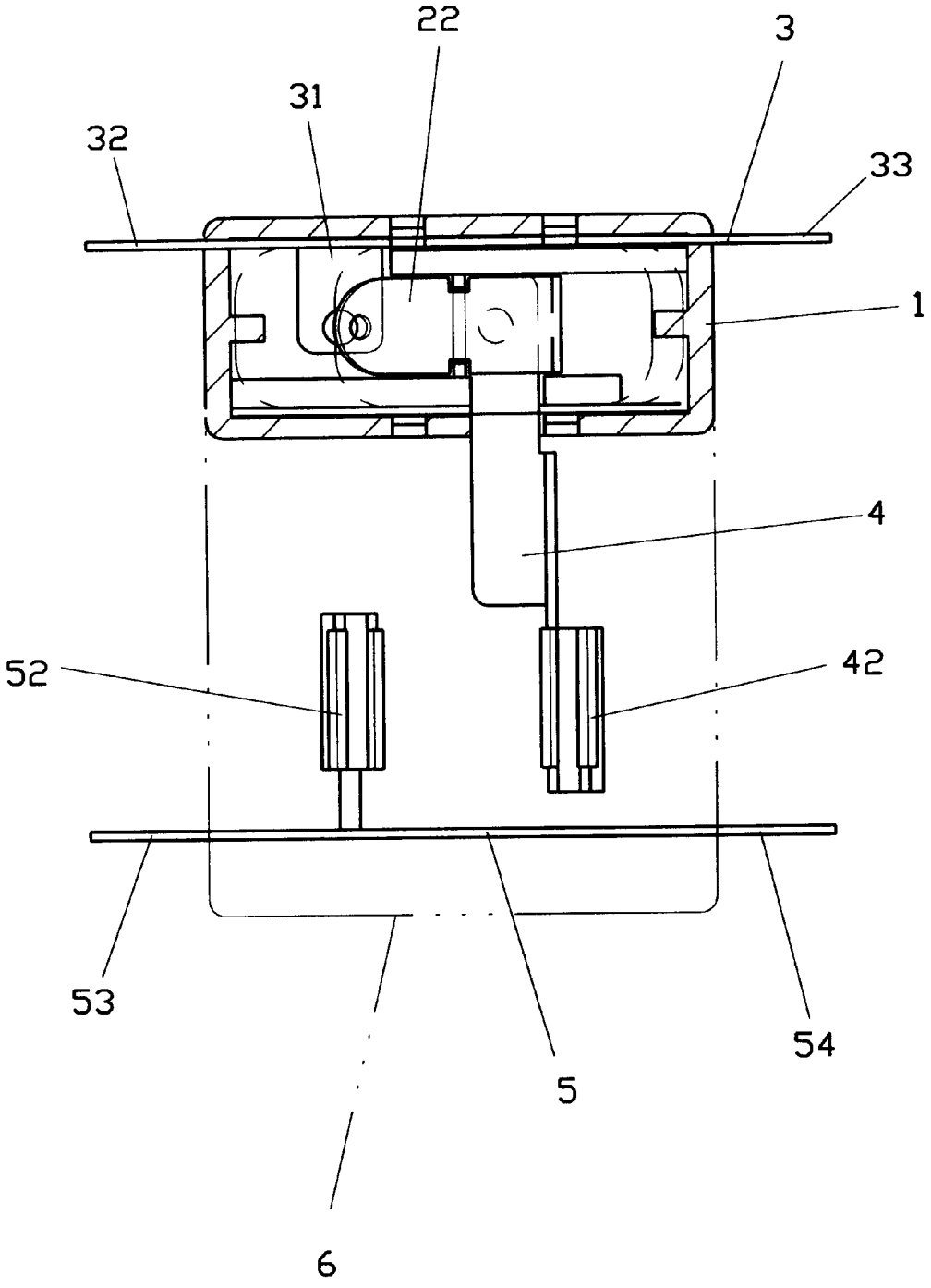
FIG. 12 is a top view of FIG. 11.
Figure 13:
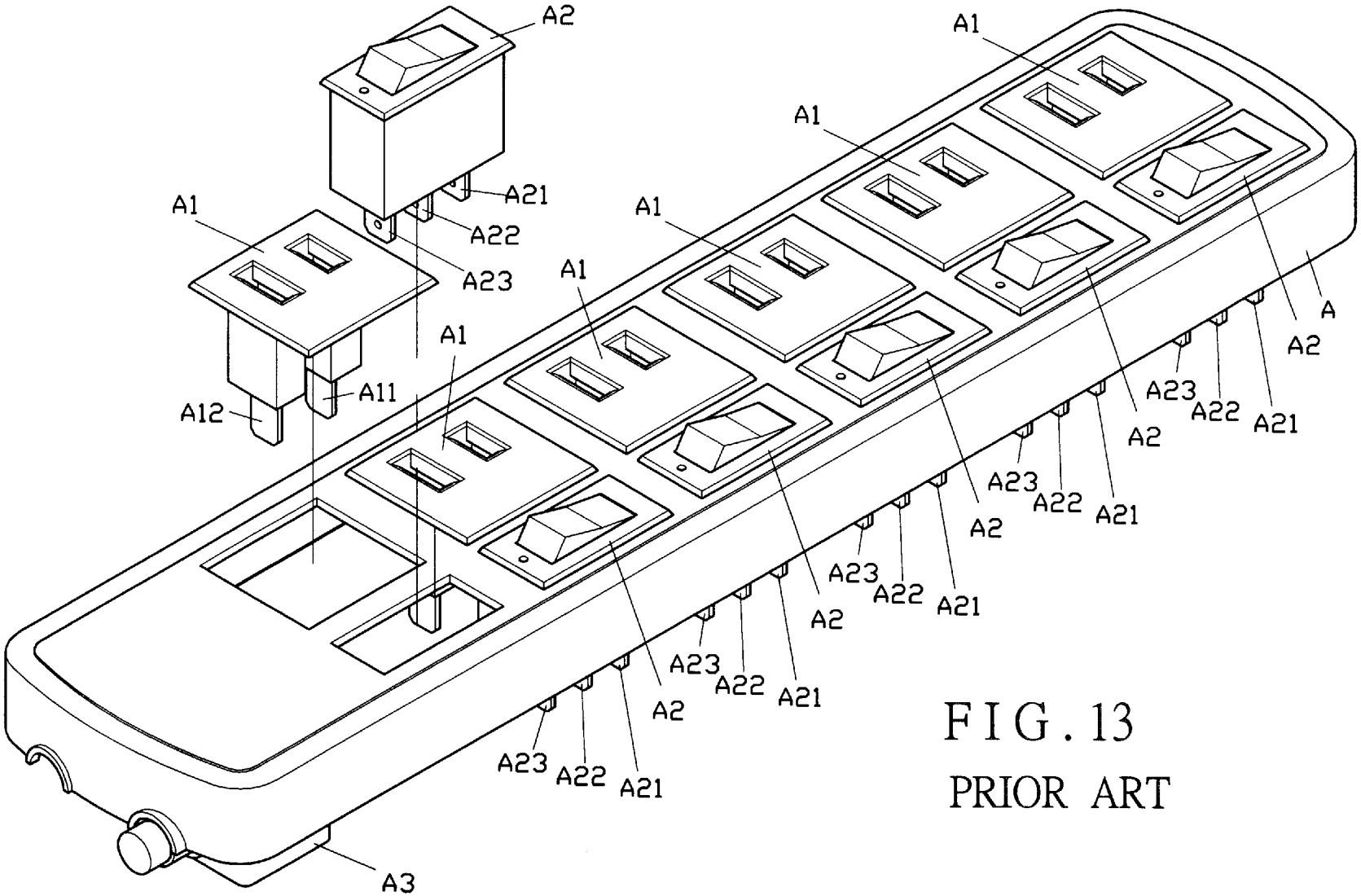
FIG. 13 PRIOR ART
FIG. 13 is a perspective view of a prior art device.
Figure 14:
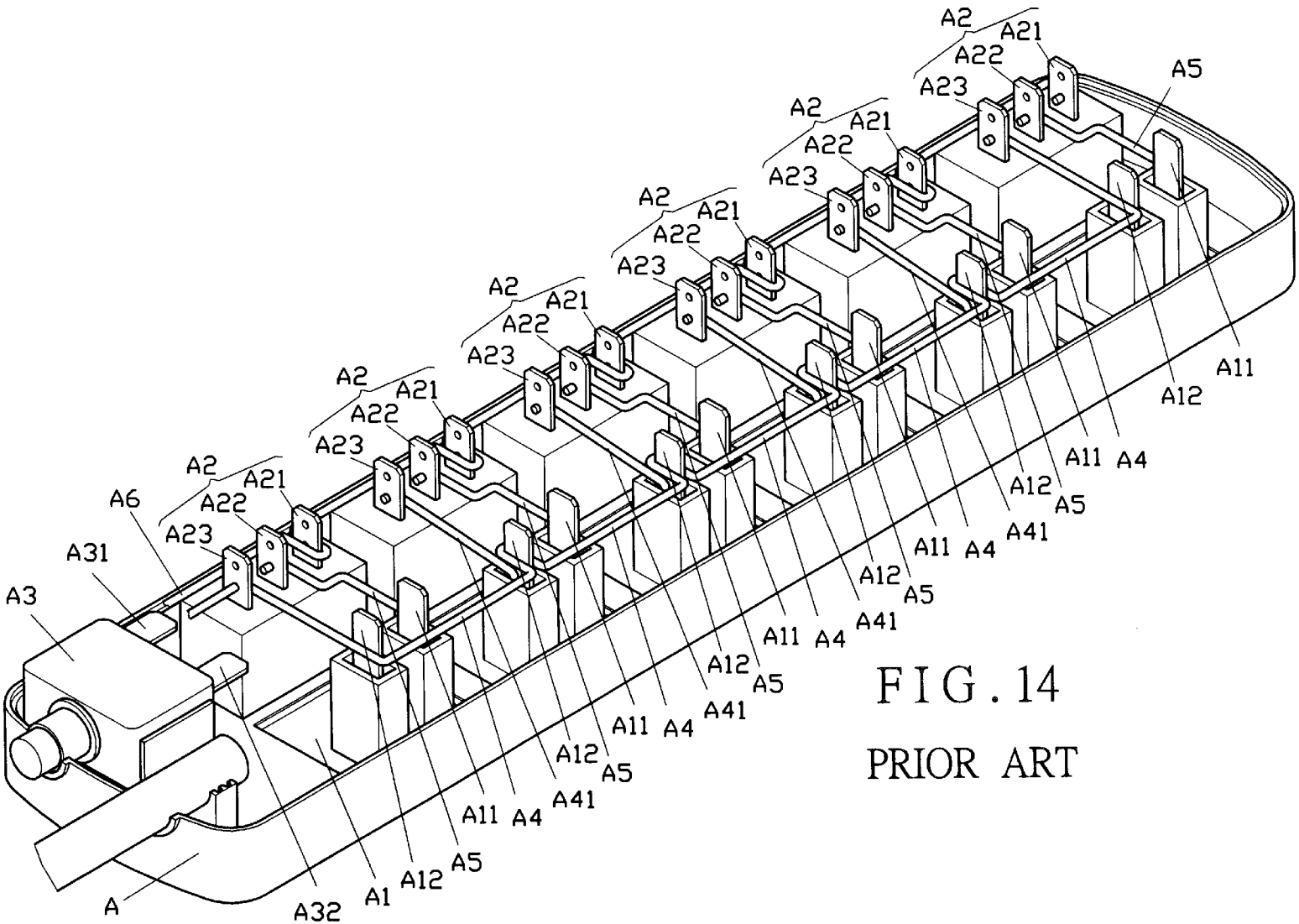
FIG. 14 PRIOR ART
FIG. 14 is a bottom view of FIG. 13.

FIGS. 11 and 12 show another embodiment where the main switch does not have a grounded conductor, but it has the first conducting plate 3 and the second conducting plate 4 of the positive conductors. The first and the second conducting plates 3 and 4 are controlled by the switch device 2 to cut off or connect power, wherein the second conducting plate 4 extends a second clip 42 which is the positive end of the receptacle 6, and the third conducting plate 5 also extends a third clip 52 which functions as the grounded end. The third clip 52 is also formed with a connecting input end 53 and a connecting output end 54 to connect with the incoming grounded terminal.

What is claimed is:

1. A main switch for an extension receptacle, comprising:

a switch housing;

a switch device disposed in said switch housing;

a plurality of conducting plates extending from said switch housing, one of said plurality of conducting plates being a conductor controlled by said switch device; and, at least a pair of contacts respectively formed on said controlled conductor and another of said plurality of conducting plates external said switch housing for forming contacts of a receptacle.

2. The main switch as recited in claim 1, wherein a pair of said plurality of conducting plates have each have a pair of end portions extending from said switch housing for respectively forming input and output connections.

3. A main switch for an extension receptacle, comprising:

a switch housing;

a switch device disposed in said switch housing;

a pair of conducting plates extending from said switch housing, a first conducting plate being a power input conductor and a second conducting plate being a conductor controlled by said switch device to be connected and disconnected from said first conducting plate;

a third conducting plate disposed external said switch housing; and, at least a pair of contacts respectively formed on said second and third conducting plates for forming contacts of a receptacle.

4. The main switch as recited in claim 3, wherein said first and third conducting plates each have a pair of end portions for respectively forming input and output connections.

* * * * *